US005848642A

United States Patent [19]

Sola

[11] Patent Number: 5,848,642

[45] Date of Patent: Dec. 15, 1998

[54] DEVICE FOR COIL TUBING OPERATIONS

[75] Inventor: Kjell Inge Sola, Tananger, Norway

[73] Assignee: Transocean ASA, Tananger, Norway

[21] Appl. No.: 809,906

[22] PCT Filed: Sep. 14, 1995

[86] PCT No.: PCT/NO95/00165

§ 371 Date: Jun. 18, 1997

§ 102(e) Date: Jun. 18, 1997

[87] PCT Pub. No.: WO96/08633

PCT Pub. Date: Mar. 21, 1996

[30] Foreign Application Priority Data

Sep. 16, 1994 [NO] Norway ..... 943470

[51] Int. Cl.[6] ..... E21B 19/22; H02G 11/02

[52] U.S. Cl. ..... 166/77.2; 137/355.16; 191/12.4

[58] Field of Search ..... 166/77.2; 137/355.12, 137/355.16, 355.17, 560; 138/110; 191/12.2 R, 12.2 A, 12.4

[56] References Cited

U.S. PATENT DOCUMENTS

| | | | |
|---|---|---|---|
| 4,661,660 | 4/1987 | von Sothen et al. | 191/12.2 A |
| 4,673,035 | 6/1987 | Gipson | 166/77.2 |
| 4,685,516 | 8/1987 | Smith et al. | 166/65.1 |
| 4,743,175 | 5/1988 | Gilmore | 166/77.2 X |
| 4,862,958 | 9/1989 | Pringle | 166/72 |
| 5,179,972 | 1/1993 | Eley | 137/355.19 |
| 5,275,198 | 1/1994 | Vollweiler et al. | 137/355.16 X |

FOREIGN PATENT DOCUMENTS

| | | |
|---|---|---|
| 256601 | 8/1987 | European Pat. Off. . |
| 565287 | 10/1993 | European Pat. Off. . |

*Primary Examiner*—David J. Bagnell
*Attorney, Agent, or Firm*—Andrus, Sceales, Starke & Sawall

[57] ABSTRACT

A device for coil tubing operations in connection with oil drilling, wherein a coil tubing (10) is adapted to carry one or more downhole tools and to supply circulation liquid to well and tool. The coil tubing has been coiled up on a rotatable drum (1) and is connected to a pump device for circulation liquid through a first swivel device (20) disposed at one end of the shaft (2) of the drum (1), and wherein within the coil tubing (10) hydraulic pipes (12, 14) and an electrical cable (16) have been passed to said downhole tool. The hydraulic pipes (12, 14) are connected to liquid pipelines (26, 28) through a second swivel device (24) at the other end of the shaft (2). The electrical cable (16) is connected to an electrical cable (34) through a third swivel device (32) at the other end of the shaft (2). The hydraulic pipes (12, 14) each has a larger length than the length of that part of the coil tubing (10) within which the hydraulic pipes (12, 14) are disposed, and the hydraulic pipes (12, 14) are disposed in the form of substantial helical lines within the coil tubing (10). At the outer end of the coil tubing (10), a hydraulic coupling device (36) is disposed, adapted to be connected to downhole tools, and wherein the hydraulic pipes (12, 14) are connected to the coupling device (36).

3 Claims, 3 Drawing Sheets

DEVICE FOR COIL TUBING OPERATIONS

BACKGROUND OF THE INVENTION

When drilling for oil and gas it is common to use so called coil tubing to guide tools and instruments down into a well.

It is usual that tools mounted at the end of the coil tubing, operate hydraulic motors or actuators. Then, hydraulic power is supplied when circulation liquid is pumped down through the coil tubing by means of a pump at the surface. Alternatively, an electrically driven downhole pump is used, operating the hydraulic tool by means of liquid taken from the well, normally in the vicinity of the tool.

In downhole operations, the circulation liquid pumped through the coil tubing often serves several purposes. The circulation liquid is often not homogenous and, thus, less suitable for driving hydraulic tools. The circulation liquid may e.g. be admixed inert gas in order to improve the lifting capability for cuttings.

When several tools are in operation simultaneously, e.g. a downhole bit motor in combination with a downhole directional control unit, both depend on the flowing circulation liquid. Upon directional changes, the bit has to be released while the angle of the bit is altered.

The use of a downhole pump does not improve the condition, but may give a better flexibility and independence when several tools are used simultaneously.

SUMMARY OF THE INVENTION

The object of the invention is to provide an improved device for transferring energy and control signals for operating downhole hydraulic tools in connection with coil tubing operations.

BRIEF DESCRIPTION OF THE SEVERAL VIEWS OF THE DRAWING

An example of an embodiment of the invention is described in the following, reference being made to the attached drawings, wherein.

DETAILED DESCRIPTION OF THE INVENTION

Figure 1:
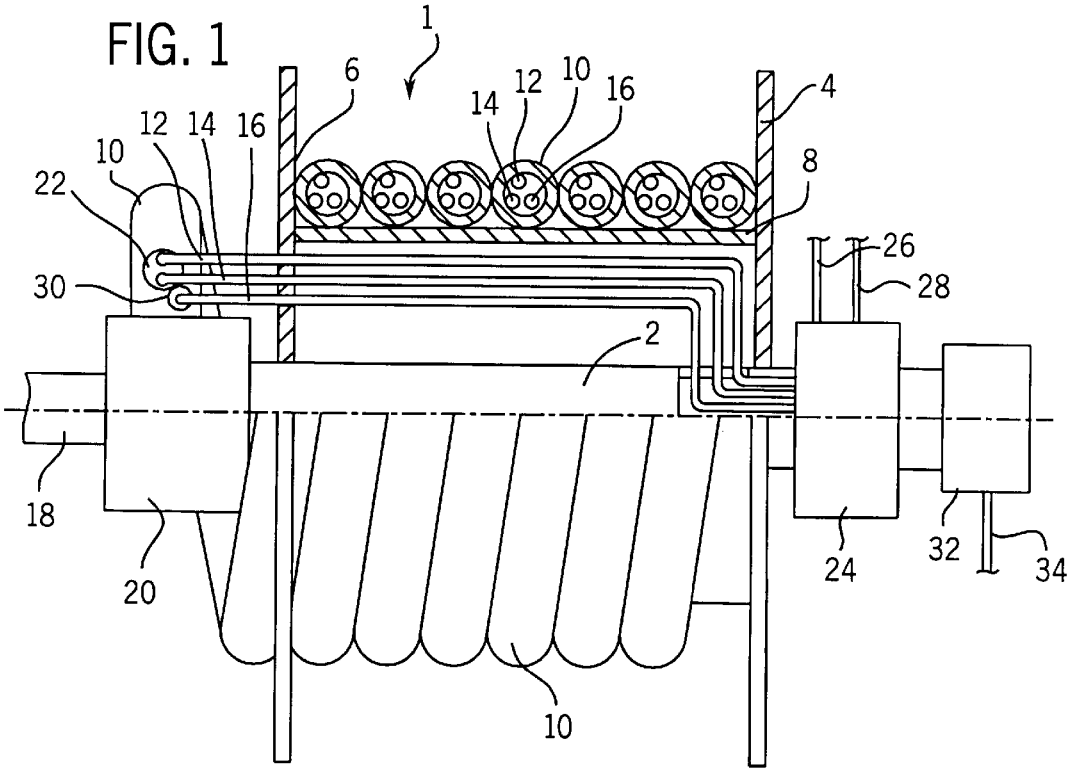
FIG. 1 shows in top plan view, partly in section, a drum having a coil tubing coiled thereon and within which an electrical cable and two hydraulic pipes extend.
Figure 2:
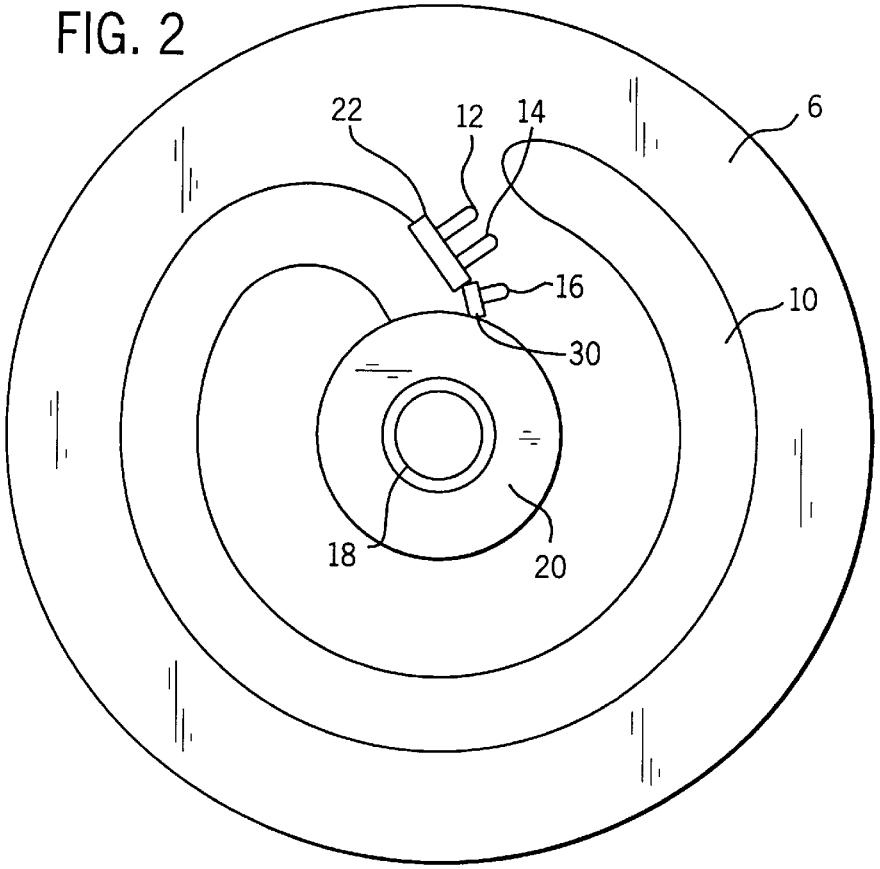
FIG. 2 shows the same drum as in FIG. 1 as shown in an end view.

In FIG. 1, reference numeral 1 denotes a drum comprising a shaft 2, side walls 4, 6 and a tubular drum core 8 on which a coil tubing 10 has been coiled up. Into the coil tubing 10, two pipes 12, 14 for hydraulic liquid as well as an electrical cable 16 have been threaded. The coil tubing 10 is adapted to conduct circulation liquid delivered from a pump device, not shown, through a supply pipe 18 and further through a first swivel device 20 of a type known, mounted at one end of the shaft 2, the coil tubing 10 being connected to the outlet of the swivel device 20. As known, the swivel device 20 is adapted to fort a pressure-tight rotary connection between the stationary supply pipe 18 and the coil tubing 10 following the rotational movements of the drum 1.

The hydraulic pipes 12, 14 extending within the coil tubing 10 have been passed into the coil tubing 10 through a pressure-tight passage 22 placed downstream in relation to the swivel device 20. Through a second swivel device 24 disposed at the other end of the shaft 2, the hydraulic pipes 12, 14 are by means of hydraulic pipes 26, 28 connected to a hydraulic aggregate, not shown. As known, the swivel device 24 is adapted to form pressure-tight rotary connection between the stationary liquid-carrying pipelines 26, 28 and the hydraulic pipes 12, 14, the latter following the rotational movements of the drum 1.

The electrical cable 16 which may contain one or mare conductors is, in a manner similar to the hydraulic pipes 12, 14, passed into the coil tubing 10 through a pressure-tight passage 30. Further, the electrical cable 16 is passed through the second swivel device 24 to a third swivel device 32 which, as known, is adapted to transfer electrical signals to an electrical cable 34 connected to electrical equipment, not shown.

By means of the three swivel devices 20, 24, 32, the following transfer operations are carried out, independently on the rotational movements of the drum 1: circulation liquid transfer to the coil tubing 10, hydraulic liquid transfer to/from the hydraulic pipes 12, 14, as well as transfer of electrical signals to/from the cable 16.

As the hydraulic pipes 12, 14 as well as the electrical cable 16 have been passed into the coil tubing 10 downstream in relation to the swivel device 20, the swivel devices 24, 32 are not subject to circulation liquid and, thus, they do not have to be pressure-tight.

Figure 3:
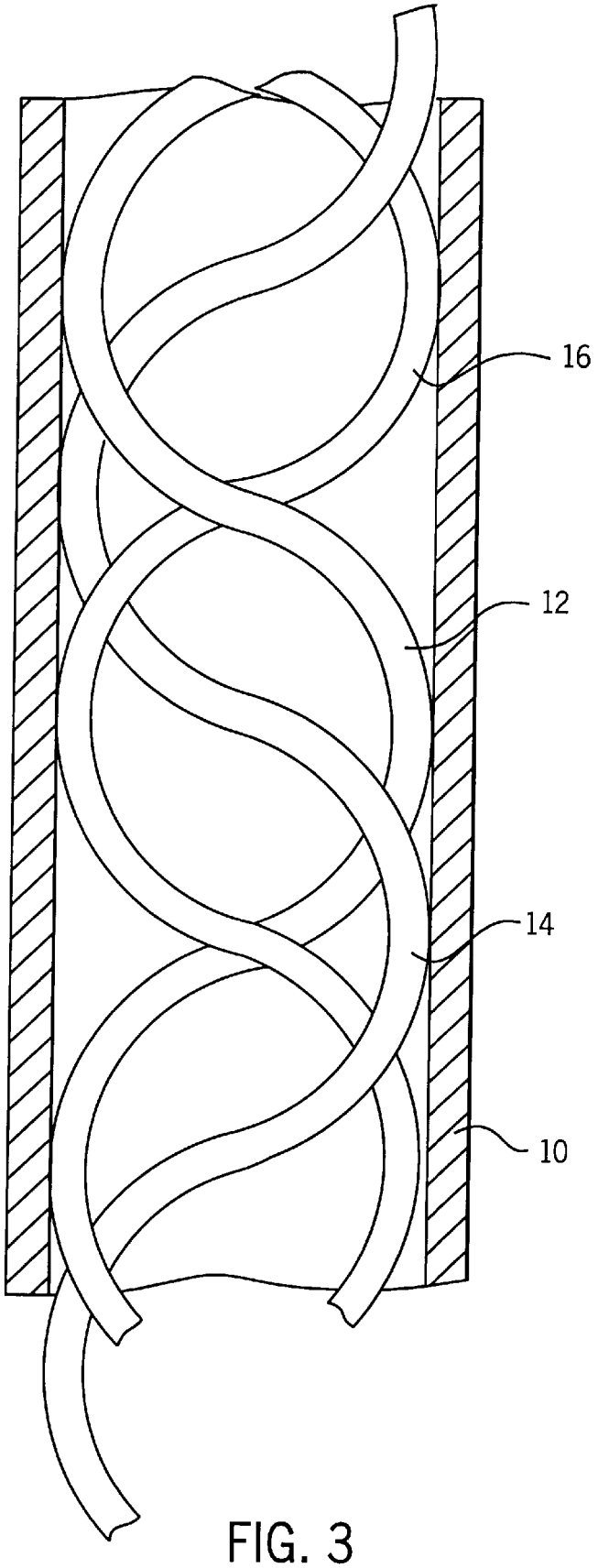
FIG. 3 shows in section and side elevational view, as well as on a larger scale, a coil tubing surrounding an electrical cable and hydraulic pipes.
Figure 4:
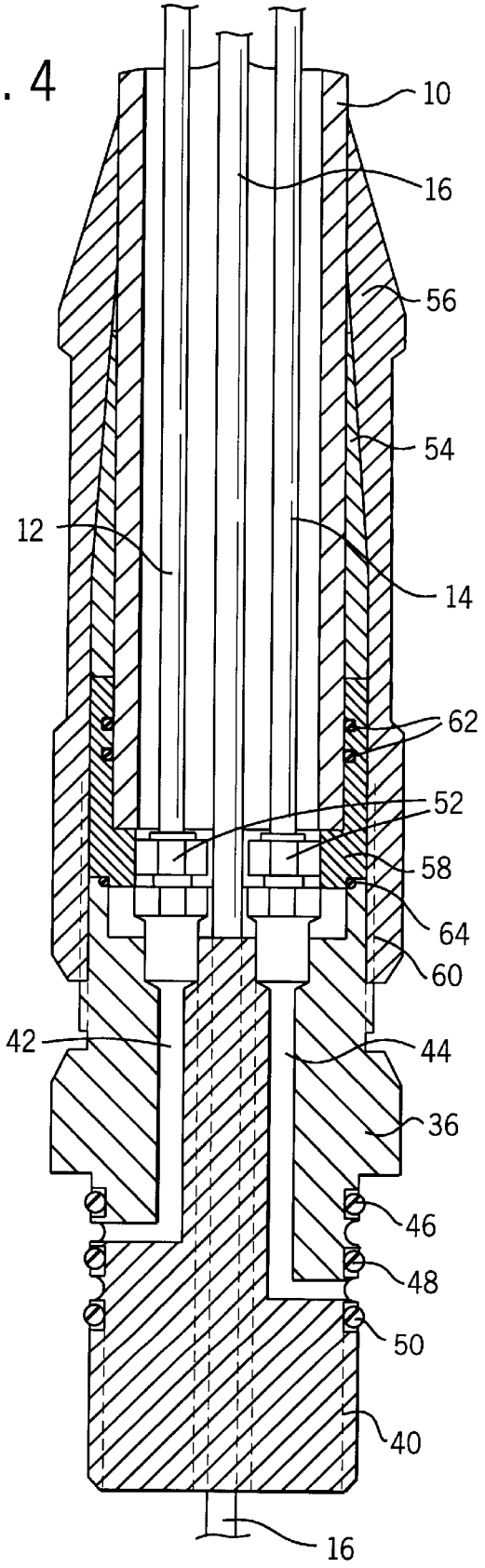
FIG. 4 shows in section and side elevational view the end of the coil tubing having a hydraulic connection device for connecting downhole equipment.

The hydraulic pipes 12, 14 and the electrical cable 16 each has a substantially larger length than the coil tubing 10 and are, thus, placed within the coil tubing in approximate helical line form such as it appears from FIG. 3, in order to give the necessary flexibility when the coil tubing 10 is uncoiled from the drum 1 and coiled up on the sale.

At the end of the coil tubing 10, a coupling device 36 has been disposed far the purpose of transferring hydraulic liquid between the hydraulic pipes 12, 14 and a hydraulic downhole tool, not shown, of a type known per se, adapted to be attached to the coupling device 36 by means of screw threads 40. The coupling device 36 is provided with internal channels 42, 44, the one end thereof opening radially between external annular seals 46, 48, 50 on the coupling device. The other end of the channels 42, 44 is adapted to be connected to the hydraulic pipes 12, 14 by means of hydraulic connectors 52 of a type known.

A split clamp sleeve 54 having an external conical portion is adapted to grip externally on the coil tubing 10 in that an external sleeve 56 is displaced axially over the conical portion of the clamp sleeve 54. Internally, the clamp sleeve 54 is provided with sharp ridges or other friction-increasing means. A support ring 58 is adapted to rest against the end of the coil tubing 10 and serve as a land area for the clamp sleeve 54 and the coupling device 36.

Annular seals 62 seal between the support ring 58 and the coil tubing 10, an annular seal 64 sealing between the support ring 58 and the coupling device 36.

When the coupling device 36 shall be fastened to the coil tubing 10, the sleeve 56, the clamp sleeve 54 and the support ring 58 are threaded onto the coil tubing 10. The hydraulic pipes 12, 14 are pulled somewhat out from the coil tubing 10 and are connected to the Coupling device's 36 channels 42, 44 by means of the hydraulic connectors 52, whereafter the coupling device 36 is pressed against the support ring 58. The sleeve 56 is screwed onto the threads 60 of the coupling device 36 and tightened. The sleeve 56 causes the clamp sleeve 54 to grasp the coil tubing 10 firmly, attaching the coupling device 36 to the end of the coil tubing 10.

The coupling device 36 is provided with a through-going liquid channel, not shown, for circulation liquid as well as a channel for passing the electrial cable 16 through, the latter terminating as known per se, having coupling devices of its own, not shown.

Advantageously, between the support ring 58 and the coupling device 36 respectively the clamp sleeve 54, pins, knobs or lugs may be disposed, preventing mutual rotation when the sleeve 56 is tightened by screwing.

I claim:

1. A device for handling coilable tubing used in underground drilling, the tubing having disposed therein hydraulic lines (12, 14) and at least one electrical cable (16), said device comprising: a rotary drum (1) mounted on a central portion of a shaft (2), the tubing being coilable on and uncoilable from said rotary drum; a first swivel device (20) positioned at one end of said shaft for connection to the coilable tubing, said first swivel being connectable to a source (18) of circulation liquid for the tubing for supplying same to the tubing; a second swivel device (24) positioned at the other end of said shaft from said first swivel device, said second swivel device being connectable to a source of hydraulic fluid (26, 28); fluid conduit means for connecting said second swivel device to the coilable tubing downstream of said first swivel device for providing fluid to the hydraulic lines (12, 14); a third swivel device (32) positioned at the other end of said shaft from said first swivel device, said third swivel device being connectable to an electrical power source (34); and electrical conduit means for coupling said third swivel device to the coilable tubing downstream of said first swivel device for providing electrical power to the electrical cable (16).

2. The device according to claim 1 wherein said third swivel means is coupled to the coilable tubing through said second swivel means.

3. The device as set forth in claim 1 including coilable tubing in which the hydraulic lines (12, 14) and the cable (16) are longer, in length, than the length of the coilable tubing in which they are disposed and wherein the hydraulic lines and cable follow elongated helical paths within the coilable tubing (10).

* * * * *